US006179087B1

(12) United States Patent
Moffat

(10) Patent No.: US 6,179,087 B1
(45) Date of Patent: Jan. 30, 2001

(54) LADDER

(75) Inventor: William Moffat, Flynn (AU)

(73) Assignee: Custom Ladder Company Pty. Ltd. (AU)

( * ) Notice: Under 35 U.S.C. 154(b), the term of this patent shall be extended for 0 days.

(21) Appl. No.: 09/069,318

(22) Filed: Apr. 29, 1998

(51) Int. Cl.[7] ..... E06C 5/00
(52) U.S. Cl. ..... 182/15; 182/17; 182/103
(58) Field of Search ..... 182/15, 16, 17, 182/103; 280/43.14

(56) References Cited

U.S. PATENT DOCUMENTS

| | | | | |
|---|---|---|---|---|
| 1,912,509 | | 6/1933 | Ballard . | |
| 2,319,581 | * | 5/1943 | Brownlee | 280/43.14 |
| 2,479,736 | | 8/1949 | Fieroh . | |
| 2,585,763 | * | 2/1952 | Gasner . | |
| 2,624,590 | * | 1/1953 | Tilton . | |
| 2,922,487 | | 1/1960 | Reitknecht | 182/16 |
| 3,155,190 | | 11/1964 | Borgman . | |
| 3,232,377 | | 2/1966 | Smith . | |
| 3,490,558 | * | 1/1970 | Foley | 182/129 |
| 3,684,055 | | 8/1972 | Rice | 182/17 |
| 3,891,062 | * | 6/1975 | Geneste | 182/103 |
| 4,063,616 | | 12/1977 | Gutierrez | 182/17 |
| 4,934,485 | | 6/1990 | Purkapile | 182/20 |
| 5,628,522 | * | 5/1997 | Hall | 280/43.14 |

FOREIGN PATENT DOCUMENTS

| | | | |
|---|---|---|---|
| 15862/70 | 12/1971 | (AU) . | |
| 160404 | 3/1933 | (CH) . | |
| 522 207 | 3/1931 | (DE) | 341/23 |
| 30 14 212 | 10/1981 | (DE) | E04G/1/24 |
| 0 727 559 A1 | 8/1996 | (EP) | E06C/1/397 |
| 2.171.571 | 9/1973 | (FR) . | |
| 452185 | 8/1936 | (GB) . | |
| 1046501 | 6/1966 | (GB) | A64B/1/26 |
| 2 057 545 | 4/1981 | (GB) | E06C/1/397 |
| 2 099 490 | 12/1982 | (GB) | E06C/1/397 |
| 08004462 | 1/1996 | (JP) | E06C/1/39 |

* cited by examiner

*Primary Examiner*—Alvin Chin-Shue
(74) *Attorney, Agent, or Firm*—Heslin & Rothenberg, P.C.

(57) ABSTRACT

A default-immobile ladder (10) includes mobility means (12) displaceable between a ladder immobile position and a ladder mobile position in which the mobility means extends downwardly beyond the foot of the ladder and manually actuable means (32) for displacing the mobility means from the ladder immobile position to the ladder mobile position. When the manually actuable means is released, the mobility means returns to the ladder immobile position.

8 Claims, 5 Drawing Sheets

LADDER

TECHNICAL FIELD

The present invention relates to an improved default-immobile ladder.

BACKGROUND ART

For safety reasons, a ladder must be immobile when used, ie. when a user is on the ladder. However, it is also desirable that the ladder can be rendered mobile for the purpose of moving the ladder to another location.

A number of different solutions have been proposed in which some form of mobility means, such as wheels and castors, have been used, with the mobility means being movable between a retracted immobile position and a downwardly extended mobile position.

It is highly desirable that the mobility means return to the retracted immobile position as a default so that, in the absence of an applied mobilising force, the ladder is immobile.

A default-immobile ladder is disclosed in French Patent Publication 2,171,571. The ladder includes a rectangular frame carrying four wheels or castors. The frame can be urged downwardly in response to actuation of a lever thereby lifting the ladder and rendering the ladder mobile. The ladder returns under gravity to the immobile position when the lever is released, ie. the immobile position is the default.

The present invention aims to provide an improved default-immobile ladder.

DISCLOSURE OF INVENTION

In one aspect the invention resides in a default immobile ladder including:

a plurality of mobility means simultaneously displaceable between a ladder immobile position in which the feet of the ladder contact a supporting surface and a ladder mobile position in which the plurality of mobility means extend beyond the feet of the ladder thereby lifting the feet of the ladder away from the supporting surface against the effect of gravity; and actuable means for simultaneously displacing the plurality of mobility means from the ladder immobile position to the ladder mobile position, wherein a mobilising force applied to the actuable means simultaneously displaces the plurality of mobility means to the ladder mobile position, whereafter a horizontal moving force applied to the actuable means moves the mobilised ladder about on the supporting surface, and wherein discontinuation of said mobilising force on the actuable means causes the plurality of mobility means to return to the ladder immobile position regardless of whether the ladder is loaded or unloaded, characterised in that the mobilising force is applied to the actuable means in a substantially vertical direction.

Preferably, the mobilising force and moving force are applied to the actuable means by a user's hands and the actuable means is adapted to receive the user's hands in horizontally spaced locations whereby steerage of the mobilised ladder on the support surface is facilitated.

Preferably, the actuable means includes a pivotably mounted lever which adopts a substantially horizontal orientation when the plurality of mobility means are in the ladder mobile position.

Preferably, the actuable means includes an integral pair of levers, each lever being operatively connected to a pair of mobility means.

In another aspect the invention resides in a default immobile ladder including:

two pairs of mobility means, each pair being displaceable between a retracted position and an extended position; and a pair of lever means, each lever means being associated with a pair of mobility means for displacing the associated pair of mobility means from the retracted position to the extended position, wherein a mobilising force applied to a lever means displaces the associated pair of mobility means to the extended position, and wherein discontinuation of said mobilising force on the lever means causes the associated pair of mobility means to return to the retracted position regardless of whether the ladder is loaded or unloaded.

Preferably, the two lever means are integral such that the two pairs of mobility means are simultaneously extended.

BRIEF DESCRIPTION OF FIGURES

In order that this invention may be more easily understood and put into practical effect, reference will now be made to the accompanying drawings which illustrate a preferred embodiment of the invention, wherein.

BEST MODE

Figure 5:
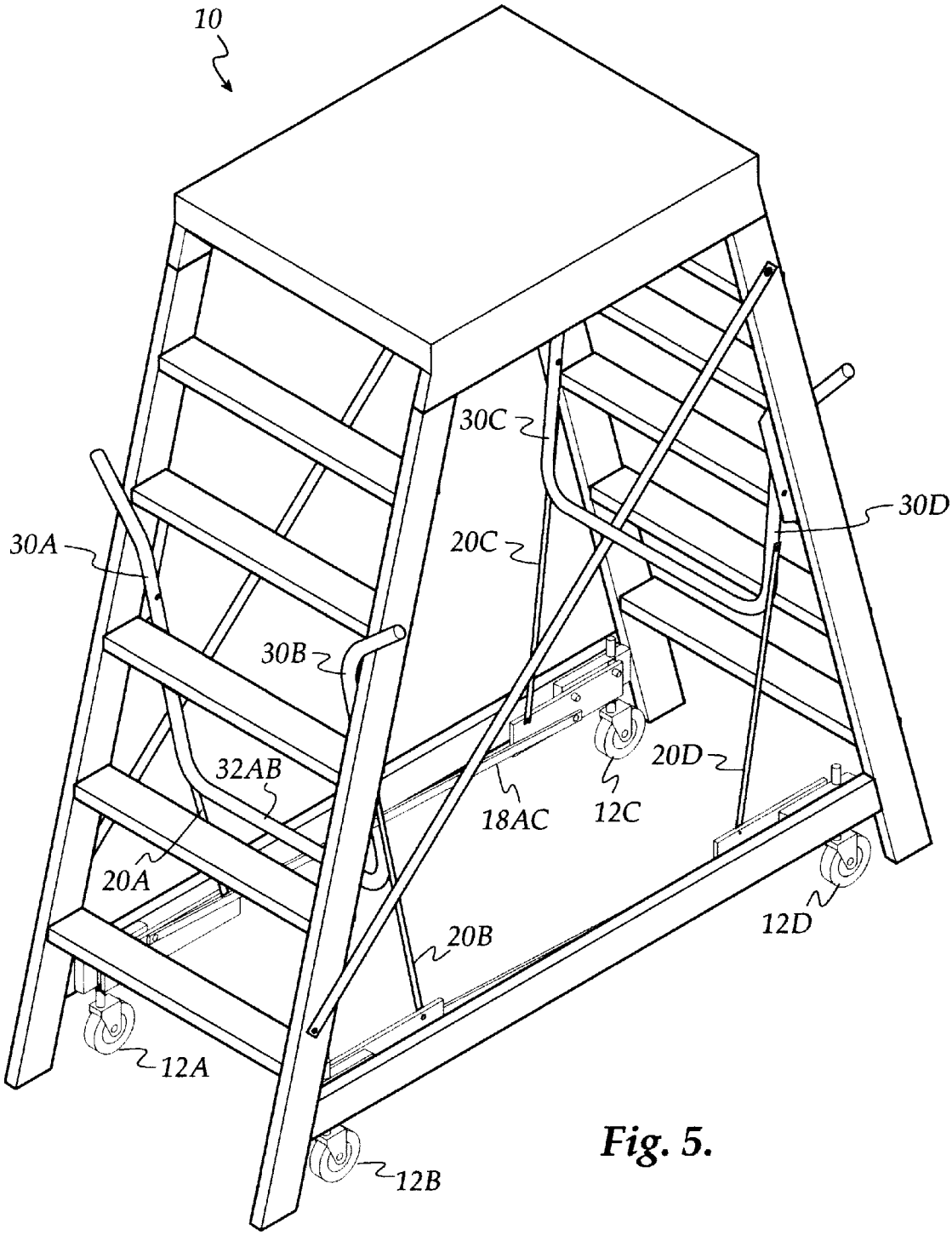
FIG. 5 is a perspective view of an A-frame ladder according to the invention in the ladder immobile position.

Referring firstly to FIG. 5, there is shown a ladder 10 having a first pair of mobility means 12A and 12C and a second pair of mobility means 12B and 12D. In the embodiment illustrated the mobility means take the form of castors.

Referring now to FIGS. 1 to 4, there is illustrated the mechanism whereby the pair of mobility means 12A and 12C may be simultaneously displaced from the ladder immobile position (FIGS. 1 and 3) to the ladder mobile position (FIGS. 2 and 4) in a master-slave relationship. Mobility means 12B and 12D are linked in an identical manner.

Figure 1:
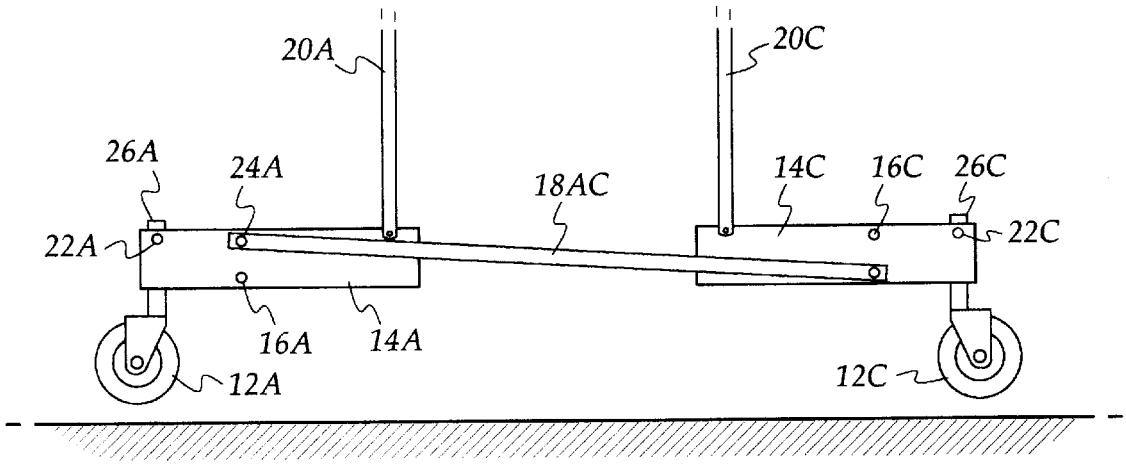
FIG. 1 is a schematic view of a linked pair of mobility means in the ladder immobile position.
Figure 3:
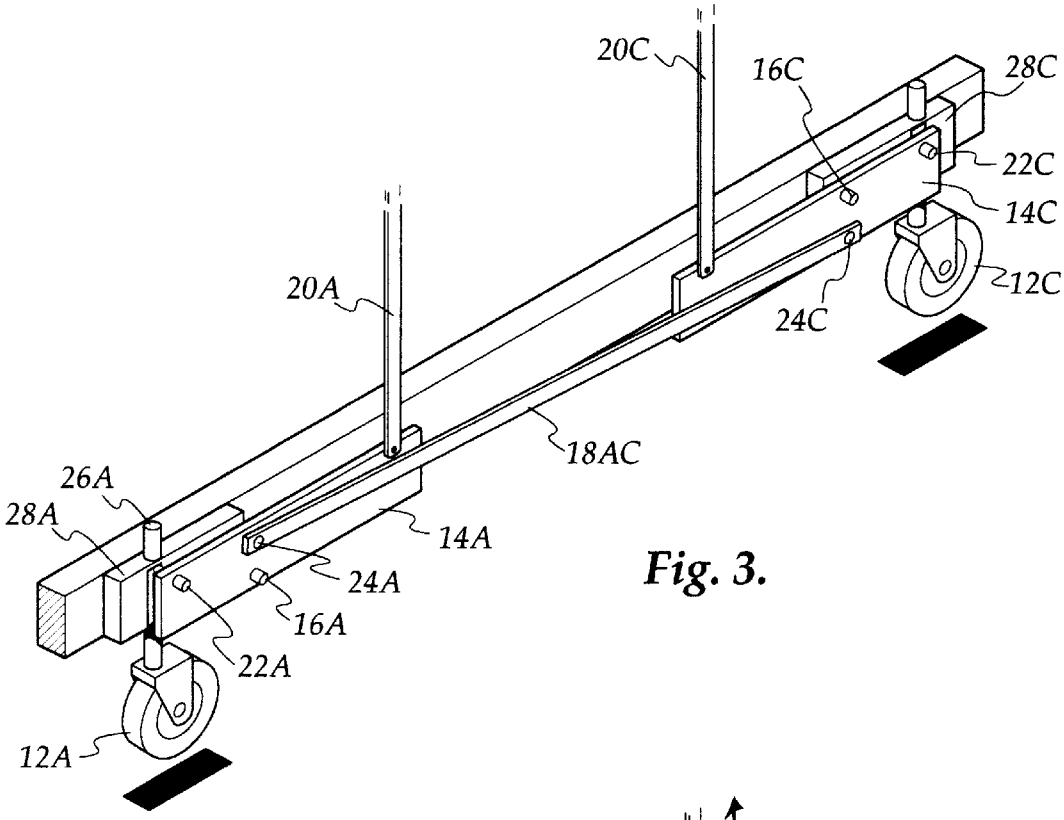
FIG. 3 is a perspective view of FIG. 1.

It should be noted that whilst the mobility means are illustrated as being spaced from the supporting surface in FIGS. 1 and 3, the mobility means will, in fact, tend to rest on the support surface when in the ladder immobile mode.

Figure 4:
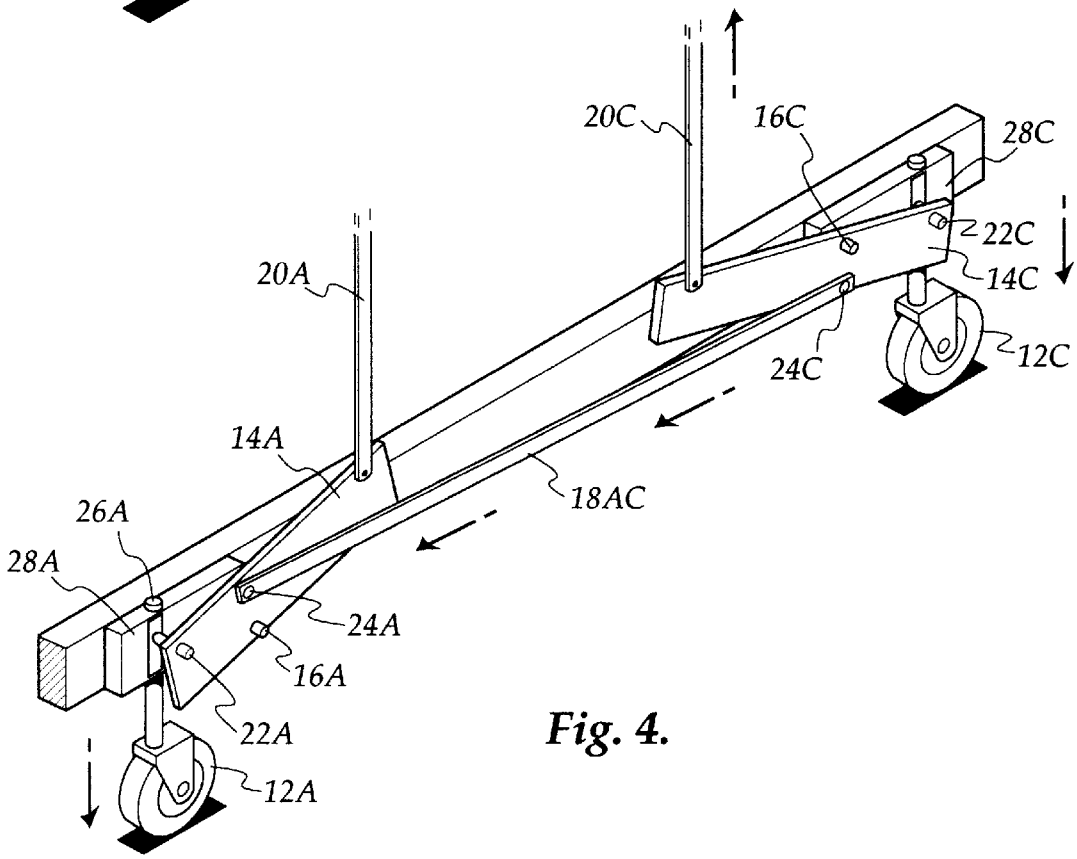
FIG. 4 is a perspective view of FIG. 2.

Referring firstly to FIG. 1, there is shown a schematic illustration of the mobility means 12A and 12C in the ladder immobile position. In this position the legs of the ladder are in contact with the supporting surface. Accordingly, the ladder is immobile. Referring to FIGS. 3 and 4, each mobility means 12 is pivotably mounted about a vertical axis on an up-standing post 26 so that the ladder can be wheeled in any direction. Up-standing post 26 is guided for vertical movement in a bore in housing 28 and is pivotably linked to link pivot member 14 at pin 22. Housing 28 is fixed to the ladder frame.

Link pivot member 14 is pivotably mounted relative to housing 28 at pin 16.

Transmitting means 20, which in the illustrated embodiment consists of a bar but could alternatively be a chain or cable, is pivotably mounted to link pivot member 14.

Figure 2:
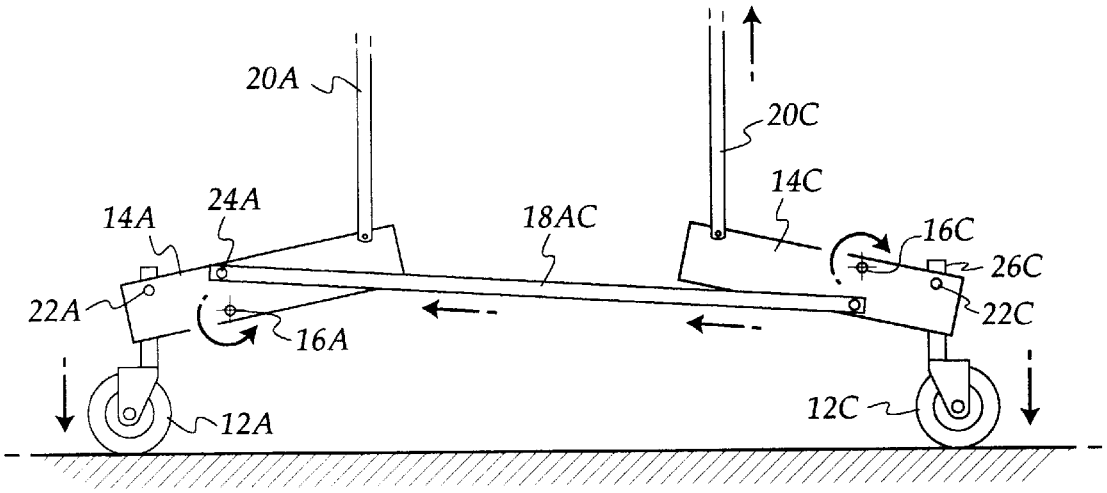
FIG. 2 is a schematic view of a linked pair of mobility means in the ladder mobile position.

It will be appreciated that upward movement of transmitting means 20 causes rotation of link pivot member 14 about pin 16 thus urging post 26 and mobility means 12 vertically downwardly into load bearing engagement with the supporting surface as illustrated in FIGS. 2 and 4. This has the effect of raising the feet of the ladder out of contact with the supporting surface and rendering the ladder mobile.

Furthermore link pivot members 14A and 14C are linked by bar member 18AC such that pivoting of one link pivot member is reflected in the other link pivot member in a master/slave relationship. A second bar member 18BD similarly extends between link pivot members 14B and 14D. The bar members 18 are pivotably mounted to the link pivot members 14 at 24. In some embodiments the bar member can be replaced by a cable, chain or the like.

Referring to FIG. 5, the upper end of transmitting means 20 is pivotably mounted to lever member 30. In the illustrated embodiment the upper end of transmitting means 20 includes a slot adapted to receive a pin disposed on lever member 30 so that the slave transmitting means 20 can move upwardly relative to the pin without displacing the slave lever member. Alternatively, transmitting means 20 can be in the form of a chain or cable which will not transmit compression forces.

Lever members 30A and 30B (FIG. 5) constitute the arms of U-shaped member 32AB. Similarly, lever members 30C and 30D constitute the arms of U-shaped member 32CD.

As previously mentioned FIG. 5 shows ladder 10 in the immobile orientation. In contrast, FIGS. 6 and 7 show ladder 10 in the mobile orientation.

Figure 6:
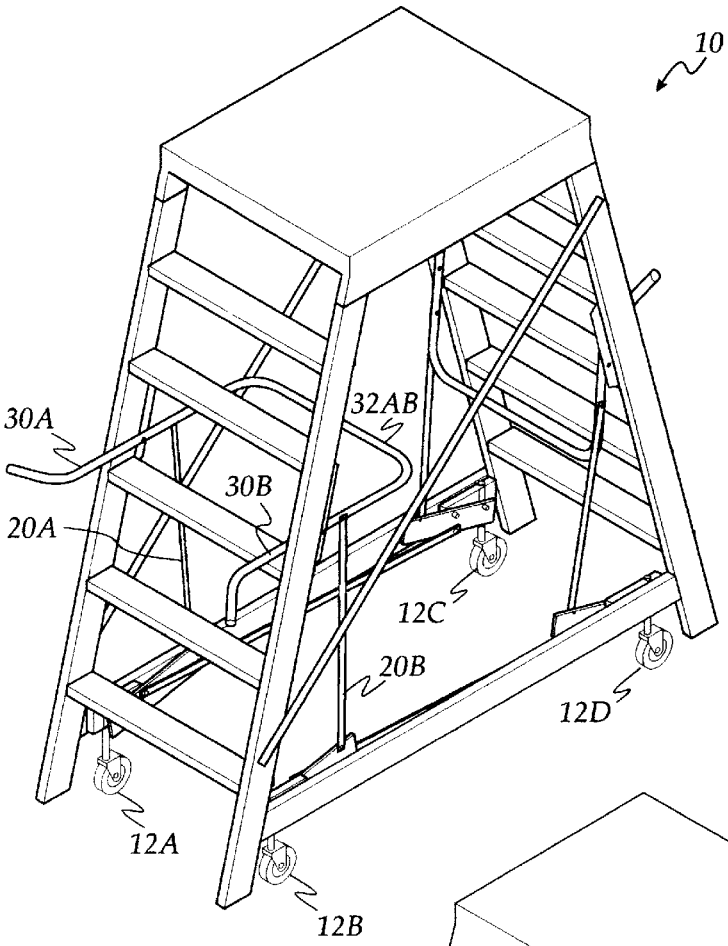
FIG. 6 is a perspective view of the A-frame ladder of FIG. 5 in the ladder mobile position.

Manual actuation of U-shaped member 32AB from the orientation shown in FIG. 5 to the orientation shown in FIG. 6 displaces transmitting means 20A and 20B upwardly which in turn pivots link pivot members 14A and 14B to urge mobility means 12A and 12B downwardly to the ladder mobile position. Simultaneously, due to pivoting of link pivot members 14A and 14B, link pivot members 14C and 14D are pivoted due to the mechanical linkage provided by bar members 18AC and 18BD. Thus, mobility means 12C and 12D are simultaneously urged downwardly to the ladder mobile position.

Figure 7:
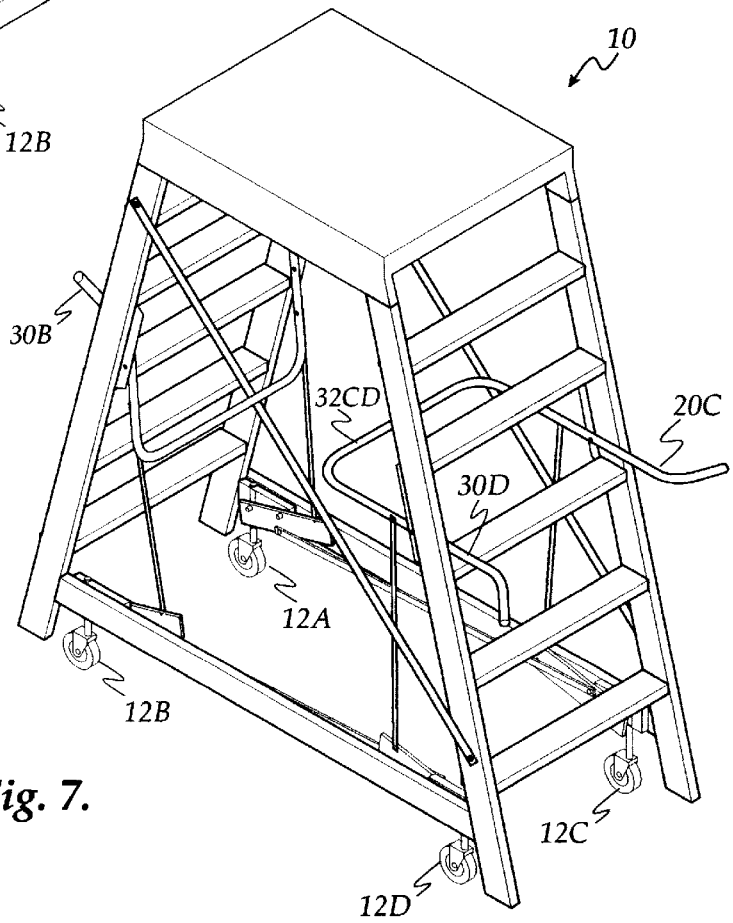
FIG. 7 is a reverse perspective view of the A-frame ladder of FIG. 5 in the ladder mobile position.

Referring now to FIG. 7, the equivalent operation has been performed by displacing U-shaped member 32CD on the other side of the ladder. Thus, the master/slave relationship has been reversed. In this instance transmitting means 20C and 20D have been pulled upwardly thereby urging mobility means 12C and 12D downwardly to the ladder mobile position. Again, due to the master/slave relationship provided by bar members 18AC and 18BD, mobility means 12A and 12B are simultaneously forced downwardly to the ladder mobile position.

When U-shaped member 32 is released the mobility means 12 return to the ladder immobile position due to gravity and the U-shaped member returns to a position where it does not impede access to the ladder (refer to FIG. 5).

Figure 8:
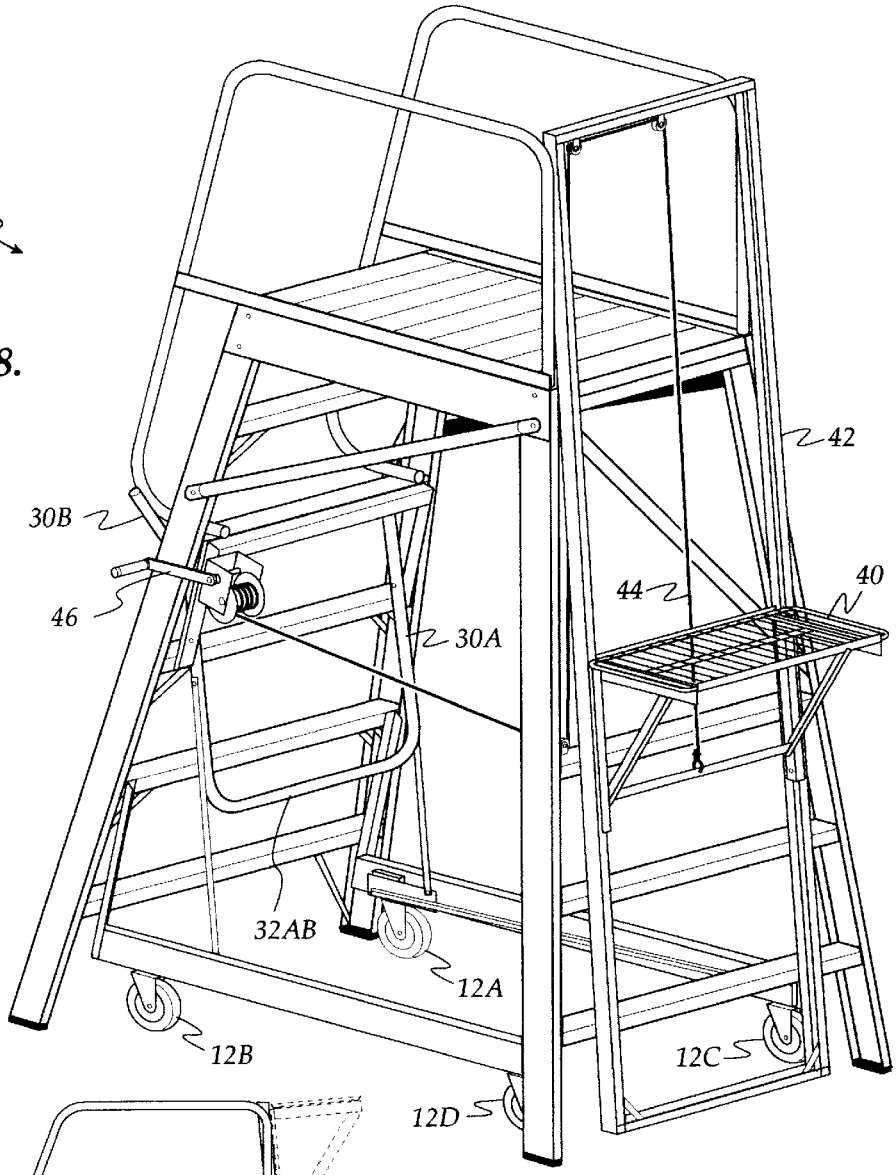
FIG. 8 is a perspective view of another A-frame ladder according to the invention in the ladder immobile position.
Figure 9:
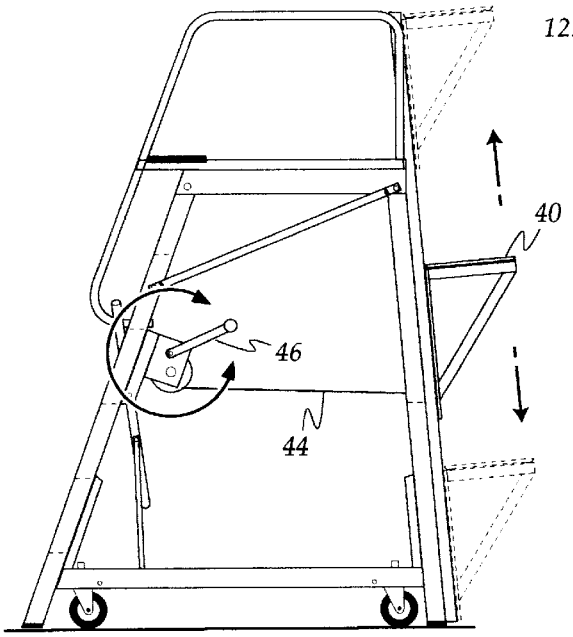
FIG. 9 is a schematic side elevation of the A-frame ladder of FIG. 8.

Whilst the embodiment illustrated in FIGS. 5 to 7 shows U-shaped members on both sides of the ladder, U-shaped member 32CD together with transmitting means 20C and 20D could be eliminated to provide another preferred embodiment in which there is only a single U-shaped member which can be used to displace all four mobility means to the ladder mobile position. Such an embodiment is shown in FIGS. 8 and 9. In this embodiment bar member 18 need only be capable of transmitting compression or tension depending on which side the U-shaped member is retained. In the illustrated embodiment, the bar member must be capable of transmitting compression and accordingly the bar member is a solid or hollow bar. However, if the U-shaped member was on the opposite side of the ladder, then the bar member would only need to be capable of transmitting tension and accordingly the bar member could also be a cable, chain or the like.

Referring to FIGS. 8 and 9 there is illustrated an A-frame ladder having one U-shaped member 32AB. On the opposite side of the ladder is guide frame 42 which mounts platform 40 for sliding vertical movement. Platform 40 can be moved up and down by hand winch 46 via cable 44 which is routed by a series of pulleys. Of course, the hand winch and cable may be replaced by any other appropriate drive system, eg. electric motor. The provision of the platform saves the operator from having to carry a package or the like down the ladder. Rather, the operator can select the desired package from shelving, place it on platform 40, dismount the ladder and then lower the platform. The ladder can then be made mobile and wheeled to the desired location. The reverse operation, of course, applies when the package is being placed on shelving rather than removed.

It will be understood that the preferred embodiment of the invention provides a ladder which is convertible between an immobile default mode in which all four legs are in contact with the supporting surface to a non-default mobile mode in which all four mobility means are in contact with the supporting surface.

An additional benefit of the preferred embodiment of the present invention is that the ladder can be converted to the mobile mode whilst loaded. In this regard packages or stores can remain on the ladder whilst the operator manually actuates the U-shaped member to convert the ladder to the mobile mode. Thus, in addition to providing an immobile or mobile ladder, the present invention also provides a ladder which can be used to transport loads horizontally, ie. the ladder can be used as a trolley.

The preferred embodiment of the invention provides a mobile ladder which is easily and ergonomically transported. The ladder is mobilised by a downward force applied by the hands of the user. This is a force which is easily and naturally generated by the user with the assistance of gravity. Once the U-shaped handle has reached its substantially horizontal orientation, further downward force is resisted by a stop mechanism. The ladder is easily controlled and steered by means of the U-shaped lift handle which places the operator in a safe, comfortable walking position relative to the ladder eliminating accidental body contact or striking of the ladder. It will be appreciated that the mobilising force is applied downwardly whilst the moving force is applied horizontally, thereby isolating the two actions. The mobilising force is resisted by the stop thereby ensuring a stable hand position. Furthermore, the horizontal moving force is applied to the actuable means at two horizontally spaced locations thereby facilitating turning and steering of the ladder.

A further benefit is achieved by having the two pairs of mobility means separately actuated by levers 30A and 30B, respectively. In this regard there is no transmission member extending transversely between mobility means 12A and mobility means 12B, or between mobilty means 12C and mobility means 12D. The absence of these transversely extending members allows the ladder to flex to a limited degree and this allows the ladder to compensate for imperfections in the supporting surface. Specifically, the flexion of the ladder allows all four feet of the ladder to contact the supporting surface even when small irregularities exist in the supporting surface. This is an additional safety feature.

It should be noted that the invention provides a default status which renders the ladder immobile and therefore safe to climb, and eliminates the possibility of accident due to an operator commencing ascent of the ladder when in the mobile mode. In this regard the ladder is immobile in the default status and the operator must actively make the ladder mobile.

The ladder provides a mechanical advantage to enable transportation of load and thereby offers a combination of both an access and materials handling device for vertical and horizontal transportation of goods.

In one embodiment the ladder also provides a vertically displacable platform which eliminates the need to carry stores up or down the ladder.

It will of course be realised that whilst the above has been given by way of an illustrative example of this invention, all such and other modifications and variations hereto, as would be apparent to persons skilled in the art, are deemed to fall within the broad scope and ambit of this invention as is herein set forth.

What is claimed is:

1. A default immobile ladder including:

a plurality of mobility means simultaneously displaceable between a ladder immobile position in which the feet of the ladder contact a supporting surface and a ladder mobile position in which the plurality of mobility means extend beyond the feet of the ladder thereby lifting the feet of the ladder away from the supporting surface against the effect of gravity;

actuable means for simultaneously displacing the plurality of mobility means from the ladder immobile position to the ladder mobile position;

the actuable means being configured so as to define a pair of horizontally spaced locations adapted to receive a user's horizontally spaced hands, the actuable means being pivotably mounted to the ladder at a horizontal pivot axis for pivoting between a substantially vertical inoperative orientation to a substantially horizontal operative orientation whereat the plurality of mobility means are simultaneously displaced from the ladder immobile position to the ladder mobile position; and wherein, when the actuable means is in the substantially horizontal operative orientation the horizontally spaced locations of the actuable means are in substantially the same horizontal plane as the horizontal pivot axis such that horizontal moving and steering forces applied to the actuable means at the horizontally spaced locations do not cause pivoting of the actuable means away from the substantially horizontal operative orientation and a mobilizing force applied to the actuable means simultaneously displaces the plurality of mobility means to the ladder mobile position, whereafter a horizontal moving force applied to the actuable means moves the mobilized ladder about on the supporting surface, and wherein discontinuation of said mobilizing force on the actuable means causes the plurality of mobility means to return to the ladder immobile position regardless of whether the ladder is loaded or unloaded, and wherein the mobilizing force is applied to the actuable means in a substantially downward vertical direction.

2. A default immobile ladder as claimed in claim 1, wherein the actuable means includes a handle and wherein the mobilizing force applied to the handle simultaneously displaces the plurality of mobility means to the ladder mobile position, whereafter the horizontal moving force applied to the handle moves the mobilized ladder about on the supporting surface and wherein discontinuation of said mobilizing force on the handle causes the plurality of mobility means to return to the ladder immobile position regardless of whether the ladder is loaded or unloaded.

3. A default immobile ladder as claimed in claim 1, wherein the ladder also includes a vertically displacable platform.

4. A default immobile ladder including:

a plurality of mobility members simultaneously displaceable between a ladder immobile position in which the feet of the ladder contact a supporting surface and a ladder mobile position in which the plurality of mobility members extend beyond the feet of the ladder thereby lifting the feet of the ladder away from the supporting surface against the effect of gravity;

a handle for simultaneously displacing the plurality of mobility members from the ladder immobile position to the ladder mobile position;

the handle configured so as to define a pair of horizontally spaced locations adapted to receive a user's horizontally spaced hands, the handle being pivotably mounted to the ladder at a horizontal pivot axis for pivoting between a substantially vertical inoperative orientation to a substantially horizontal operative orientation whereat the plurality of mobility members are simultaneously displaced from the ladder immobile position to the ladder mobile position; and wherein, when the handle is in the substantially horizontal operative orientation the horizontally spaced locations of the handle are in substantially the same horizontal plane as the horizontal pivot axis such that horizontal moving and steering forces applied to the handle at the horizontally spaced locations do not cause pivoting of the handle away from the substantially horizontal operative orientation and a mobilizing force applied to the actuable means simultaneously displaces the plurality of mobility means to the ladder mobile position, whereafter a horizontal moving force applied to the actuable means moves the mobilized ladder about on the supporting surface, and wherein discontinuation of said mobilizing force on the actuable means causes the plurality of mobility means to return to the ladder immobile position regardless of whether the ladder is loaded or unloaded, and wherein the mobilizing force is applied to the actuable means in a substantially downward vertical direction.

5. A default immobile ladder as claimed in claim 4, wherein the ladder also includes a vertically displaceable platform.

6. A default immobile ladder as claimed in claim 4, wherein the mobility members comprise members from the group consisting of wheels and castors.

7. A default immobile ladder as claimed in claims 2, or 4, wherein the handle is U-shaped and the pivot axis passes through arms of the U-shaped handle opposing each other such that the handle returns to the substantially vertical inoperative orientation under the effect of gravity when released by the user.

8. A default immobile ladder as claimed in claims 2, or 4, wherein the pivot axis is approximately 1 meter above the level of the supporting surface.

* * * * *

UNITED STATES PATENT AND TRADEMARK OFFICE

CERTIFICATE OF CORRECTION

PATENT NO. : 6,179,087 B1

DATED : January 30, 2001

INVENTOR(S) : William Moffat

It is certified that error appears in the above-identified patent and that said Letters Patent are hereby corrected as shown below:

ON THE TITLE PAGE:

Insert the following Item Numbers:

(22) PCT Filed: Oct. 24, 1996

(86) PCT No.: PCT/AU96/00672

§ 371 Date: November 4, 1997

(87) PCT Pub. No.: WO97/16621

PCT Pub. Date: May 09, 1997

UNITED STATES PATENT AND TRADEMARK OFFICE

CERTIFICATE OF CORRECTION

PATENT NO. : 6,179,087 B1

DATED : January 30, 2001

INVENTOR(S) : William Moffat

It is certified that error appears in the above-identified patent and that said Letters Patent is hereby corrected as shown below:

(30) Foreign Application Priority Data

Oct. 31, 1995 [AU] Australia ..... PN 6279

Signed and Sealed this

Fifteenth Day of May, 2001

*Attest:*

Nicholas P. Godici

NICHOLAS P. GODICI

*Attesting Officer*

*Acting Director of the United States Patent and Trademark Office*